US005414454A

United States Patent [19]

Reid

[11] Patent Number: 5,414,454

[45] Date of Patent: May 9, 1995

[54] SLIT NOZZLE TAPE FOR INKJET PRINTHEAD

[75] Inventor: W. Bruce Reid, Solana Beach, Calif.

[73] Assignee: Hewlett-Packard Company, Palo Alto, Calif.

[21] Appl. No.: 55,608

[22] Filed: Apr. 30, 1993

[51] Int. Cl.[6] ..... B41J 2/165

[52] U.S. Cl. ..... 347/29

[58] Field of Search ..... 346/140 R, 1.1; 347/44, 347/29.22; 156/252, 290, 291

[56] References Cited

FOREIGN PATENT DOCUMENTS 145157 8/1984 Japan .

125851 6/1986 Japan ..... 346/140 R 77435 3/1993 Japan ..... 346/140 R

*Primary Examiner*—Benjamin R. Fuller

*Assistant Examiner*—N. Le

[57] ABSTRACT

Slits are cut in a nozzle tape and aligned with encapsulant beads on a printhead. The slits mechanically decouple portions of the tape stuck to the beads from a central portion of the tape stuck to a nozzle plate, and thereby prevent lifting of the tape off the nozzle plate in the event that the tape subsequently contracts. A method of attaching the tape to the printhead aligns blades with the beads on the printhead, so that the blades cut slits in the tape that are aligned with the beads. The tape is then adhesively secured to the printhead, preserving the alignment.

7 Claims, 3 Drawing Sheets

SLIT NOZZLE TAPE FOR INKJET PRINTHEAD

BACKGROUND OF THE INVENTION

1. Field of the Invention

This invention relates to inkjet printheads and, in particular, to sealing nozzle holes in an inkjet printhead to prevent leakage of ink during shipping and storage.

2. Description of Related Art

A plastic tape has been used on inkjet printheads mounted to a print cartridge to seal ink ejection nozzles during shipping and storage of the print cartridge. Sealing the nozzles is intended to stop ink from seeping from the nozzles and clogging the nozzles. Sealing also prevents evaporation of the ink as well as prevents the ink from being contaminated.

FIG. 1 illustrates a prior art inkjet print cartridge 10. Print cartridge body 12 contains liquid ink which is supplied to a substrate (not shown) secured to the back of a nozzle plate 16, which may be formed of metal, plastic, or any other suitable material. The substrate incorporates heater resistors located within ink vaporization chambers. When a heater resistor is energized, a drop of ink is ejected from an associated nozzle 17 formed in nozzle plate 16.

A flexible circuit 18 comprises a polymer tape and has conductive traces (not shown) formed thereon having ends which are bonded to electrodes on the periphery of the substrate surface. The traces are bonded to the electrodes using an automated bonder. Raised epoxy beads 20 are dispensed along the edges of nozzle plate 16 to protect and encapsulate the substrate electrodes and the ends of the traces.

The other ends of the conductive traces terminate in contact pads 22, which contact electrodes of an ink printer when print cartridge 10 is installed in the ink printer.

A flexible plastic nozzle tape 26 is adhesively secured over nozzle plate 16 during storage of print cartridge 10 in an attempt to prevent ink from seeping out of nozzles 17.

FIGS. 2A, 2B, and 2C are taken along line A—A in FIG. 1 and illustrate a drawback of the prior art nozzle tape 26 of FIG. 1.

Nozzle tape 26 in FIG. 2A is positioned over nozzle plate 16 and pressed onto nozzle plate 16 with an applicator 30 (FIG. 2B). A substrate 32 is shown supporting nozzle plate 16.

Tape 26 must seal securely on nozzle plate 16 to prevent leakage of ink from nozzles 17, and the adhesive on tape 26 must be a low-tack adhesive so that the user can easily remove tape 26 from nozzle plate 16 without damaging the printhead or leaving adhesive residue.

Typically, tape 26 is wider than nozzle plate 16 and, therefore, extends over encapsulant beads 20. Adhesion of tape 26 to encapsulant beads 20 is stronger that the adhesion of tape 26 to nozzle plate 16, primarily because the typical tape adhesive used bonds more strongly to epoxy than nozzle plate 16.

Tape 26 commonly has internal tension which may be present when tape 26 is applied to the printhead or may arise because of temperature changes or as the tape shrinks with age. The tension in tape 26 applies a contracting force along the surface of tape 26. The strong bond to beads 20, being above the plane of nozzle plate 16, acts to pull the shrinking tape 26 away from the surface of nozzle plate 16, as shown in FIG. 2C. The lifted tape 26 (FIG. 2C) exposes nozzles 17 and permits leakage of ink 34.

Many attempts have been made to solve the problem of tape lifting. One attempt applies heat and pressure to the tape once the tape is stuck to the nozzle plate. The heat and pressure deform the tape to relieve upward tension in the tape. One problem with deforming the tape is the deformation is not always permanent, and tension is not eliminated. Another problem is the heat and pressure used to deform the tape can damage the nozzle plate or printhead.

A narrow tape, which fits between the beads 20, is successful at preventing tape lifting when the narrow tape is properly aligned with beads 20. However, in volume manufacturing, the close alignment tolerances required by narrow tape are difficult to achieve.

Accordingly, a tape that seals nozzles, does not lift up, and can be inexpensively and accurately applied in volume manufacturing is needed.

SUMMARY OF THE INVENTION

Two parallel slits are cut in a nozzle tape and aligned with the epoxy protrusions or beads on a printhead. The slits mechanically decouple portions of the tape stuck to the beads from portions of the tape stuck to the nozzle plate, and thereby prevent tape lift-up caused by tension in the tape.

DETAILED DESCRIPTION OF THE PREFERRED EMBODIMENTS

Figure 1:
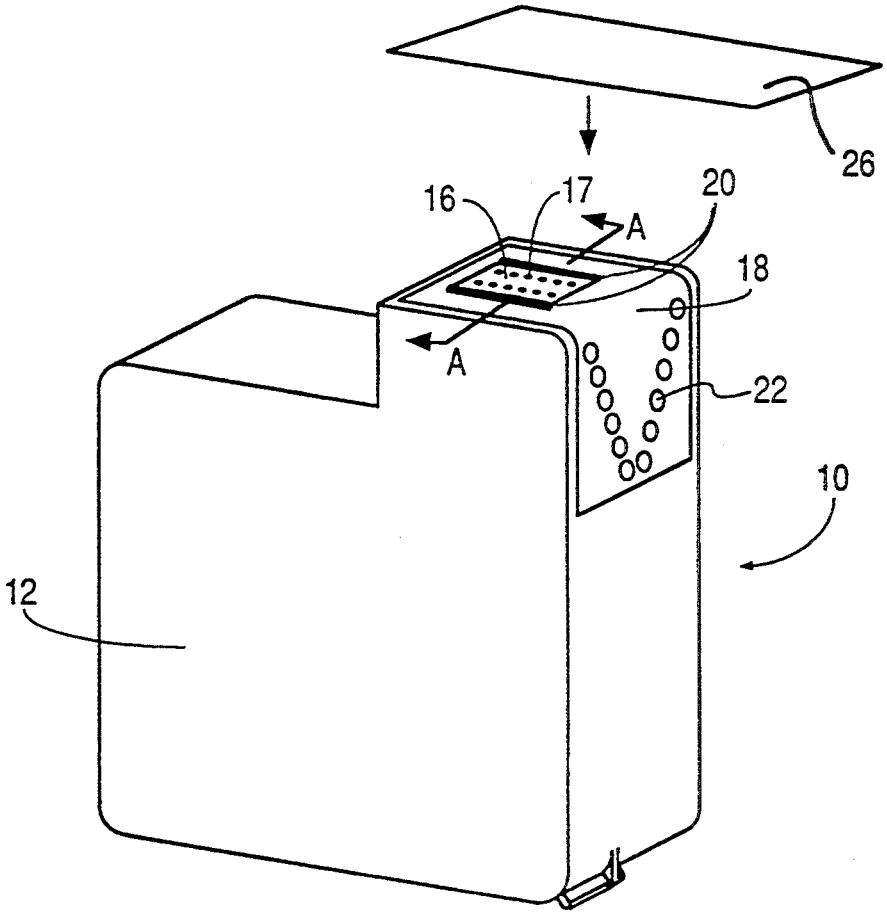
FIG. 1 (PRIOR ART)
FIG. 1 illustrates a prior art print cartridge and nozzle tape.
Figure 3:
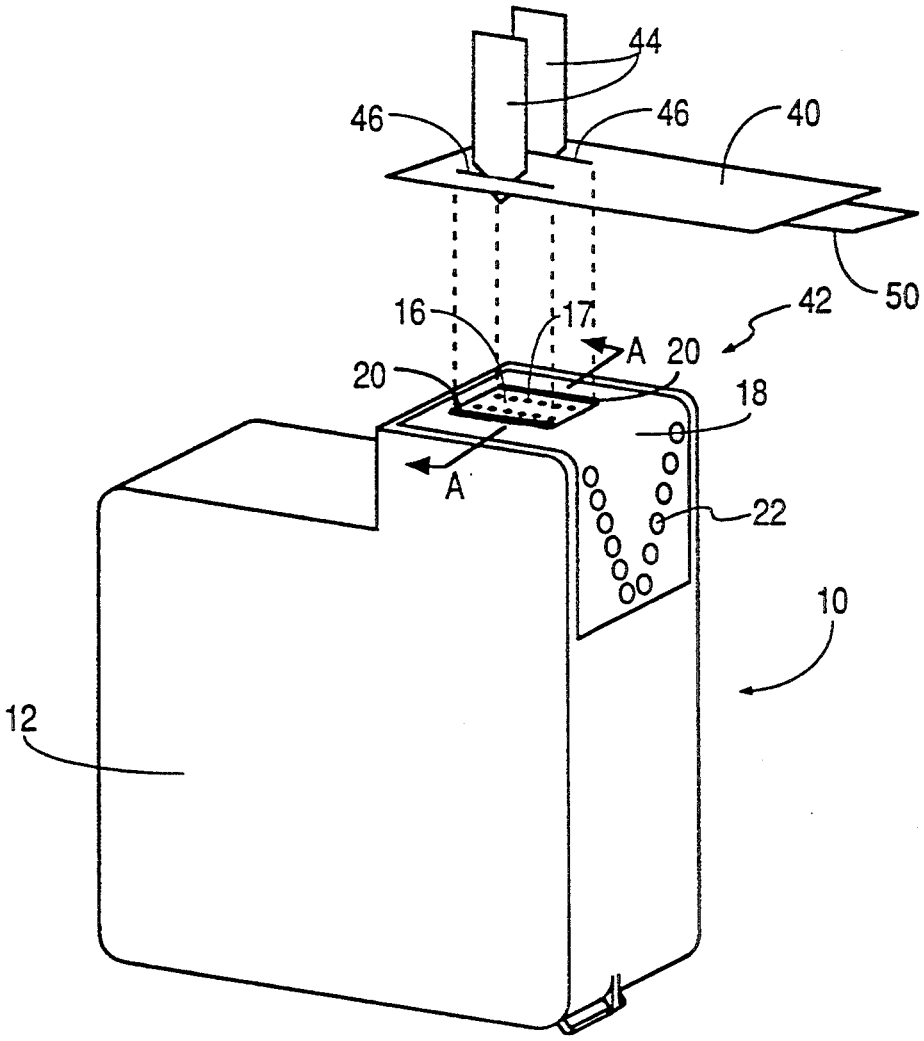
FIG. 3 shows the alignment of the slits in a preferred embodiment nozzle tape with the epoxy beads on a print cartridge.

FIG. 3 illustrates a method for forming slits in an adhesive polymer tape 40 and attaching the adhesive tape 40 to a printhead portion 42 of a print cartridge 10. Print cartridge 10 may be identical to the print cartridge 10 in FIG. 1.

Tape 40 in FIG. 3 is initially provided on a roll, cut to the appropriate length, and dispensed under a pair of blades 44. Blades 44 are aligned with beads 20 such that the resulting slits in tape 40 will reside within the margin between epoxy beads 20, yet still fully cover nozzles 17 in nozzle plate 16. Tape 40 is then brought into contact with blades 44 to cut parallel slits 46 in tape 40. Tape 40 is then pressed onto printhead 42 in the direction of arrow 45 in FIG. 3.

Figure 4:
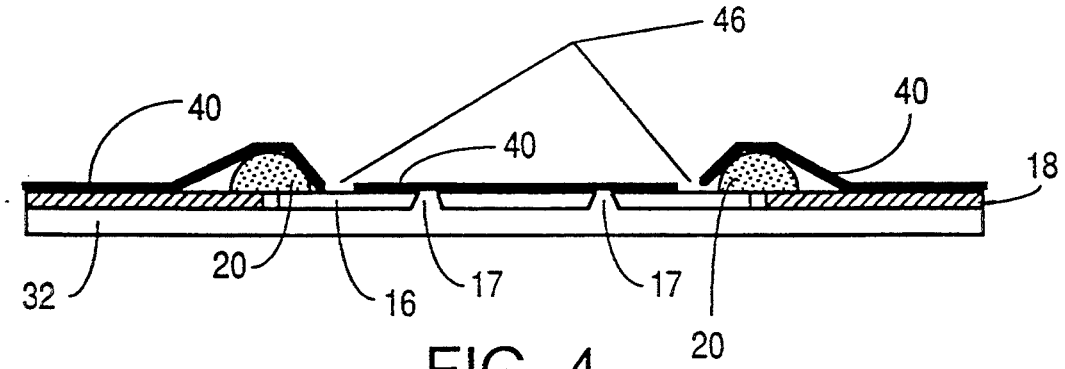
FIG. 4, taken along line A—A in FIG. 3, shows a slit nozzle tape after being secured to the nozzle plate of FIG. 3.

FIG. 4 is a cross-section along line A—A in FIG. 3 showing how the center portion of tape 40 between slits 46 remains flush against nozzle plate 16 despite any shrinkage of tape 40, due to the mechanical decoupling of the center portion of tape 40 from the peripheral portions of tape 40 secured to beads 20. Substrate 32 is shown supporting nozzle plate 16.

In the preferred embodiment method, blades 44 reside directly over beads 20 when print cartridge 10 is properly positioned to have tape 40 attached to it. Slits 46, once formed, are kept within their respective planes while tape 40 is brought down for attachment to print cartridge 10.

Figure 2A:
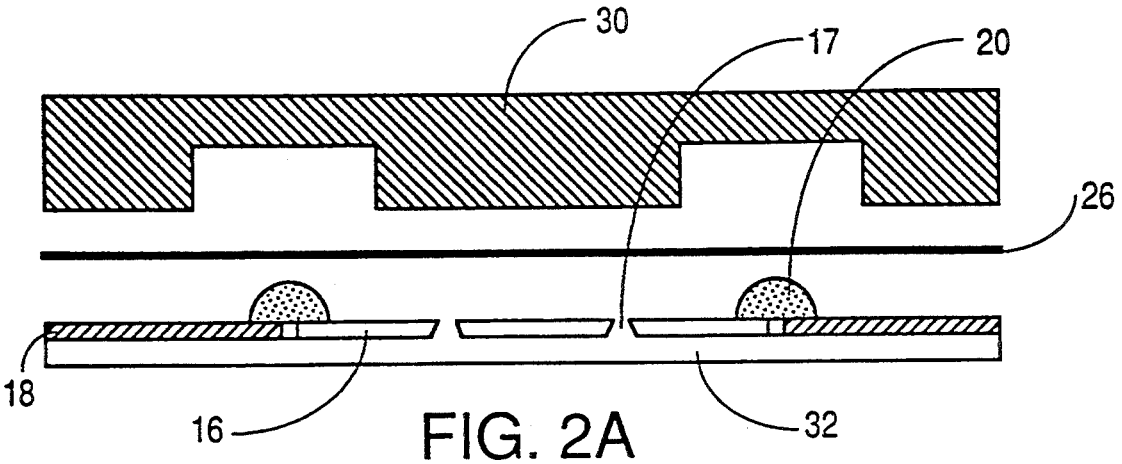
FIG. 2A (PRIOR ART)
FIGS. 2A, 2B, and 2C, taken along line A—A in FIG. 1, illustrate the nozzle tape in FIG. 1 being pressed on and being lifted off a nozzle plate.
Figure 2B:
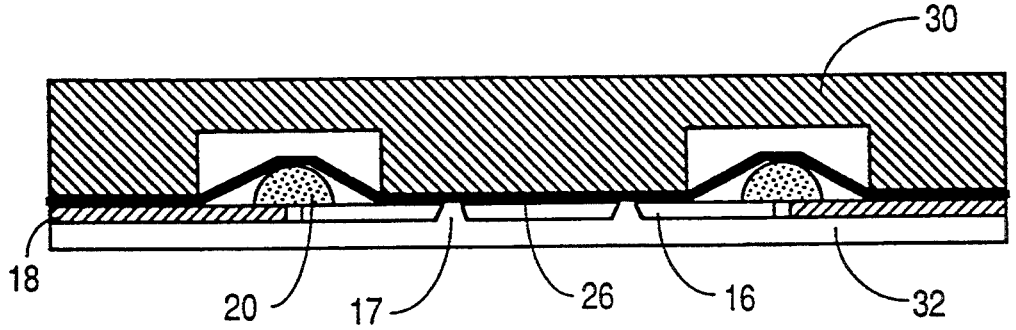
FIG. 2B (PRIOR ART)
Figure 2C:
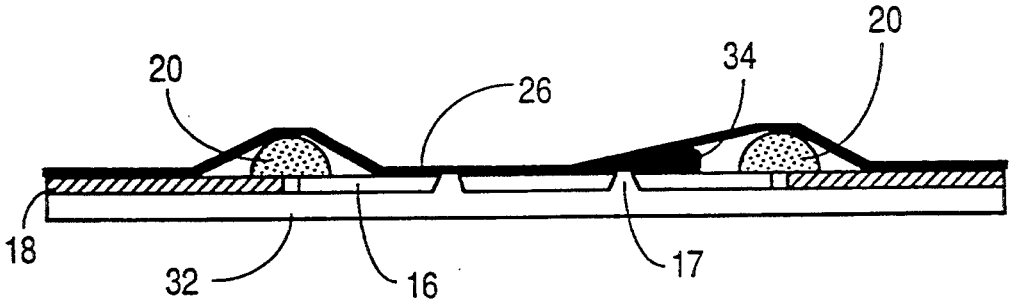
FIG. 2C (PRIOR ART)

An applicator, similar to applicator 30 in FIG. 2A, is then used to press tape 40 onto printhead 42.

Tape 40 may be provided with a non-adhesive tab 50 to facilitate gripping of tape 40 and removal by the user.

Tape 40 need not be precisely aligned with print cartridge 10, beads 20, or blades 44, because the position of the edges of tape 40 is not critical to sealing nozzles 17 in nozzle plate 16. Regardless of the position of the edges of tape 40, if blades 44 and beads 20 are aligned, the portion of tape 40 stuck to nozzle plate 16 provides a seal that is mechanically decoupled from the portions of tape 40 stuck to beads 20. Similarly, the size of tape 40 is not critical, as long as tape 40 is wider than nozzle plate 16 and provides a sufficient margin for any misalignment of tape 40.

Slit nozzle tape 40 has an advantage over narrow tape because blades 44 are easier to keep aligned with respect to beads 20 than the narrow tape is to keep aligned with the edges of nozzle plate 16.

Further, the slit nozzle tape 40 requires only minimal pressure to stick to a printhead. There is no need for pressure or heating which could damage the printhead. Further, the slit nozzle tape 40 may be made less tacky to allow easier and cleaner removal than is possible with prior art tapes.

Accordingly, the described method produces a novel nozzle tape which does not lift off a nozzle plate when subject to shrinkage forces and is relatively simple to manufacture in volume.

Although the present invention has been described in detail, the description is only an illustration of the invention's application and should not be taken as a limitation. The scope of the invention is defined only by the following claims.

What is claimed is:

1. A method for ink-sealing nozzles in a nozzle member, comprising the steps of:

providing a printhead having a nozzle member with one or more protruding beads of material along one or more peripheral edges of said nozzle member;

providing a flexible tape having a width which is wider than a width of said nozzle member;

cutting one or more slits in said tape which are aligned with said one or more protruding beads; and attaching said tape to said printhead so that a first portion of said tape is affixed to a surface of said nozzle member, said one or more slits separating said first portion from a second portion of said tape affixed to said one or more beads.

2. The method of claim 1 wherein said step of cutting includes aligning a cutting blade with each of said one or more protruding beads such that said one or more slits are aligned with said one or more protruding beads.

3. The method of claim 1 wherein said one or more protruding beads comprises two parallel beads, and said one or more slits comprises two parallel slits aligned with said beads.

4. The method of claim 1 wherein said printhead is located on a print cartridge.

5. The method of claim 1 wherein said beads of material are epoxy beads protecting conductors along said one or more peripheral edges of said nozzle member.

6. A nozzle tape secured to a nozzle member on an inkjet printhead comprising:

an adhesive tape having one or more slits cut therethrough, wherein said slits are aligned with one or more protruding beads of material along one or more peripheral edges of said nozzle member and mechanically decouple a first portion of said tape that contacts said nozzle member from a second portion of said tape that contacts said beads, said first portion acting to seal nozzles in said nozzle member.

7. The nozzle tape of claim 6 wherein said beads comprise two parallel beads along two edges of said nozzle member, and said slits comprise two parallel slits aligned with said beads.

* * * * *